US006342757B1

(12) United States Patent
Shin et al.

(10) Patent No.: US 6,342,757 B1
(45) Date of Patent: Jan. 29, 2002

(54) CATHODE RAY TUBE FOR MULTIMEDIA

(75) Inventors: Hyun-jung Shin; Bum-choon Seo; Jong-bin Lee, all of Suwon (KR)

(73) Assignee: Samsung Display Devices, Co., Ltd., Kyungki-Do (KR)

( * ) Notice: Subject to any disclaimer, the term of this patent is extended or adjusted under 35 U.S.C. 154(b) by 0 days.

(21) Appl. No.: 09/691,416

(22) Filed: Oct. 17, 2000

Related U.S. Application Data

(63) Continuation of application No. 09/061,952, filed on Apr. 17, 1998, now abandoned.

(30) Foreign Application Priority Data

Jun. 4, 1997 (KR) ..... 97-23035

(51) Int. Cl.[7] ..... H01J 29/07
(52) U.S. Cl. ..... 313/403
(58) Field of Search ..... 313/403, 402; 445/47

(56) References Cited

U.S. PATENT DOCUMENTS 4,859,901 A * 8/1989 Thompson-Russell ..... 313/403
5,928,047 A * 7/1999 Ishibashi et al. ..... 445/47

* cited by examiner

*Primary Examiner*—Michael H. Day
(74) *Attorney, Agent, or Firm*—Christie, Parker & Hale, LLP

(57) ABSTRACT

A cathode ray tube for multimedia includes a shadow mask having a plurality of beam-guide apertures. Each of the beam-guide apertures has a stripe shape and the ratio of a horizontal length of an effective screen to a horizontal pitch of the beam-guide apertures in the center of the shadow mask is in the range of $1:8.81\times10^{-4}$ to $1:1.23\times10^{-3}$. The ratio of the horizontal pitch of the beam-guide apertures in the center of the shadow mask to the thickness of the shadow mask is in the range of 1:0.25 to 1:0.56.

2 Claims, 5 Drawing Sheets

CATHODE RAY TUBE FOR MULTIMEDIA

CROSS REFERENCE TO RELATED APPLICATION

This application is a continuation of application Ser. No. 09/061,952, filed on Apr. 17, 1998, now abandoned, which claimed the priority of Korean patent application No. 97-23035 filed Jun. 4, 1997, the disclosures of which are incorporated herein by reference as if set forth in full.

BACKGROUND OF THE INVENTION (a) Field of the Invention

The present invention relates to a cathode ray tube (CRT) for multimedia and a method of making the same and, more particularly, to a method of making a multimedia CRT which simultaneously produces high resolution and high brightness for use in both computers requiring high-resolution and televisions or videos requiring high-brightness.

(b) Description of the Related Art

Generally, in the CRT, the electron beam emitted from the electron gun passes through the beam-guide apertures of the shadow mask having a color selection function while it is deflected by the deflection yoke. Then it excites the phosphors coated on the panel screen to produce the picture image.

A plurality of dot, slit or stripe-shaped apertures for guiding the electron beam are formed on the shadow mask, the shadow mask having a curvature ratio identical with that of the inside of the panel.

The stripe matrix type shadow mask, having a high beam-permeability, is used in the CRT for televisions or videos requiring high-brightness (collectively referred to hereinafter as "public CRT") while the dot matrix type shadow mask, having a fine-pitch, is used in the CRT for computers or data processors requiring high-resolution (collectively referred to hereinafter as "industrial CRT"). That is to say, the public CRT requires high-brightness to display clear pictures on the screen which are capable of being viewed from a long distance. On the other hand, the industrial CRT requires high-resolution to display distinct letters or symbols on the screen.

The CRT using a stripe matrix type shadow mask has a beam-permeability higher than that using a dot matrix type shadow mask. Conversely, the CRT using a dot matrix type shadow mask with a fine pitch (the distance between neighboring beam-guide apertures) has a resolution higher than that using the stripe matrix type shadow mask.

The permeability R of the electron beam is mathematically given by the following formula:

$$R=((\text{area of beam-guide aperture}\times\text{number of beam-guide aperture})/\text{whole area of shadow mask})\times 100\%, \quad (1)$$

where the permeability of the electron beam may be calculated by the permeability per unit area or the area of the beam-guide aperture per pitch area (horizontal pitch× vertical pitch).

Therefore, Eq. 1 may be rewritten by $$R=(\text{area of beam-guide aperture}/(\text{horizontal pitch}\times\text{vertical pitch}))\times 100\%. \quad (2)$$

Using Eqs. 1 or 2, it can be shown that the permeability R of the CRT using the dot matrix type shadow mask is about 17 to 19% while the permeability of the CRT using the stripe matrix type shadow mask is about 20 to 22%.

For example, the permeability of a 15-inch industrial CRT using a dot matrix type shadow mask can be given by $$R=((2\times\pi\times 0.06^2)/(0.27\times 0.4677))\times 100=17.9\%. \quad (3)$$

The permeability R of a 17-inch industrial CRT using a dot matrix type shadow mask is given by $$R=((2\times\pi\times 0.06^2)/(0.26\times 0.4677))\times 100=18.6\%. \quad (4)$$

The permeability R of a 25-inch public CRT using a stripe matrix type shadow mask is given by $$R=((0.65\times 0.18)/(0.76\times 0.73))\times 100=21.08\%. \quad (5)$$

The permeability of a 24-inch wide public CRT using a stripe matrix type shadow mask is given by $$R=((0.6\times 0.175)/(0.76\times 0.73))\times 100=21.17\%. \quad (6)$$

As described above, in the prior art, the CRT using a stripe matrix type shadow mask has a resolution unsuitable for industrial usage while the CRT using a dot matrix shadow mask has a brightness unsuitable for public usage. Therefore, one CRT cannot be used for both industrial and public purposes.

However, as multimedia computer systems, incorporating televisions, videos and computers to display combinations of moving and still pictures, and words, or television systems having an Internet connection function, became more developed and come into wide use, the need for a CRT having both high-brightness and high-resolution increases.

SUMMARY OF THE INVENTION

Accordingly, an embodiment of the present invention is directed to a CRT for multimedia which substantially obviates one or more of the problems due to the limitations and disadvantages of the related art.

An object of an embodiment of the present invention is to provide a method of making a multimedia CRT for simultaneously producing high brightness and high resolution.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To accomplish these and other advantages, the multimedia CRT includes a shadow mask having a plurality of beam-guide apertures. Each of the beam-guide apertures has a stripe shape, and the ratio of the horizontal length of the effective screen to the horizontal pitch of the beam-guide apertures in the center of the shadow mask is in the range of $1:8.81\times10^{-4}$ to $1:1.23\times10^{-3}$.

Furthermore, the ratio of the horizontal pitch of the beam-guide apertures in the center of the shadow mask to the thickness of the shadow mask is in the range of 1:0.25 to 1:0.56.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

In the following detailed description, only the preferred embodiment of the invention has been shown and described, simply by way of illustration of the best mode contemplated by the inventor(s) of carrying out the invention. As will be realized, the invention is capable of modification in various other respects, all without departing from the invention. Accordingly, the drawings and description are to be regarded as illustrative in nature, and not as restrictive.

DETAILED DESCRIPTION OF THE INVENTION

Reference will now be made in detail to the preferred embodiments of the present invention, examples of which are illustrated in the accompanying drawings.

As shown in FIGS. 1 to 4, a multimedia CRT according to a preferred embodiment of the present invention includes a shadow mask 10 having a plurality of stripe-shaped beam-guide apertures 22 where the ratio of the horizontal length L of the effective screen to the horizontal pitch P of the beam-guide apertures 22 in the center of the shadow mask 10 is in the range of $1:8.81\times10^{-4}$ to $1:1.23\times10^{-3}$.

A multimedia CRT according to another preferred embodiment of the present invention includes a shadow mask 10 having a plurality of stripe-shaped beam-guide apertures 22 where the ratio of the horizontal pitch P of the beam-guide apertures 22 in the center of the shadow mask 10 to the thickness t of the shadow mask 10 is in the range of 1:0.25 to 1:0.56.

Figure 1:
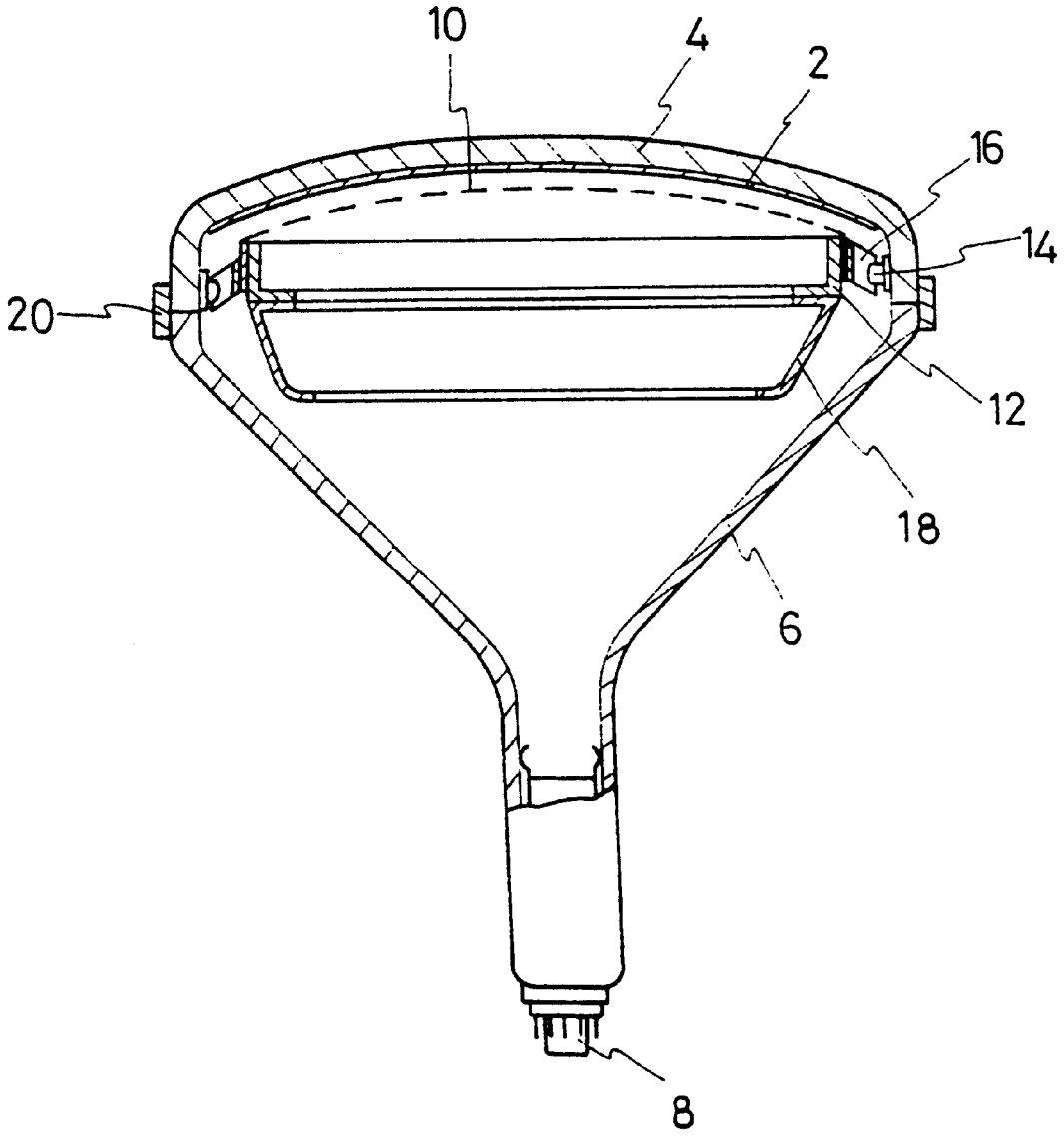
FIG. 1 is a partial sectional view of a multimedia CRT according to an embodiment of the present invention.

As shown in FIG. 1, the multimedia CRT according to an embodiment of the present invention includes a front panel 4 having a phosphor screen 2 and a funnel 6 connected to the rear of the panel 4. The funnel 6 has a neck portion into which an electron gun 8 is fitted. In addition, a shadow mask 10 is placed directly behind the phosphor screen 2 and supported by a mask frame 12.

A plurality of stud pins 14 are fixed on the side interior of the panel 4 to support the mask frame 12 through corresponding hook springs 16. An inner shield 18 is further provided under the mask frame 12 to interrupt the influence of the earth's magnetic field. Additionally, an explosion proof band 20 is provided on the external sealing portion between the panel 4 and funnel 6.

Figure 2:
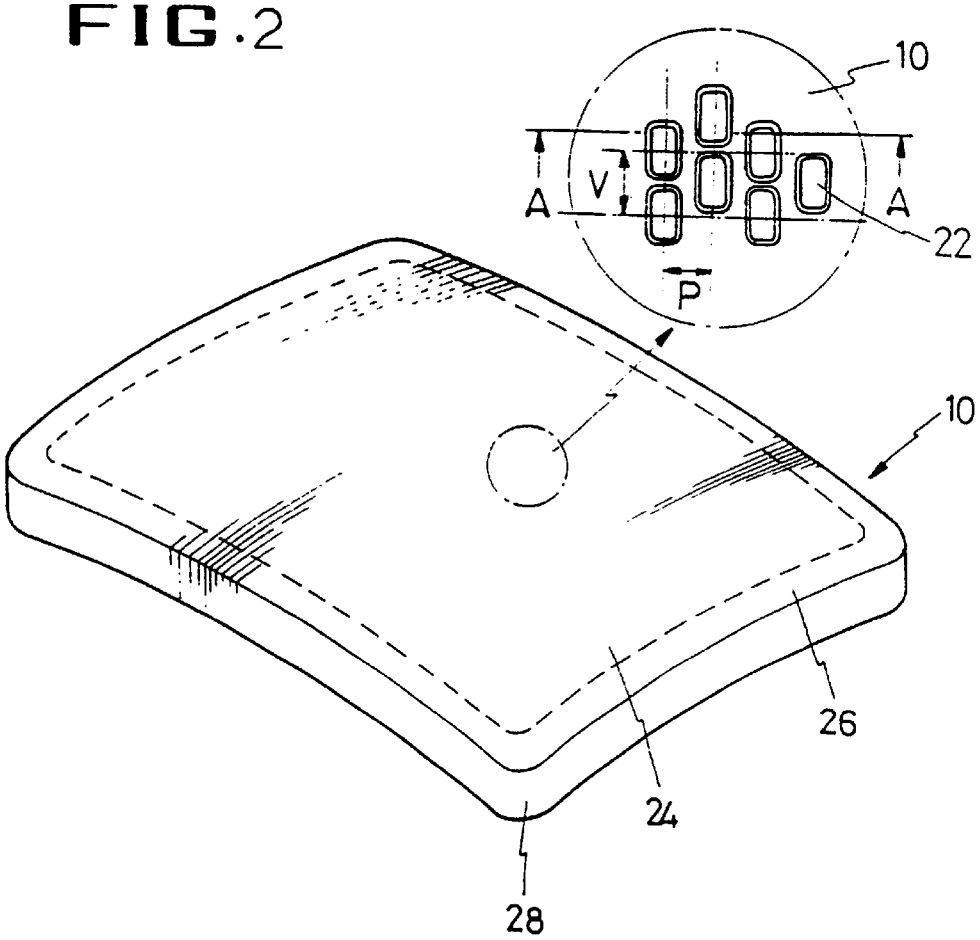
FIG. 2 is a perspective view of a shadow mask according to an embodiment of the present invention.

As shown in FIG. 2, the shadow mask 10 has a masking portion 24 having hundreds of thousands of fine beam-guide apertures 22, a closed peripheral portion 26 having no apertures, and a skirt portion 28 welded to the mask frame 12.

Each of the beam-guide apertures 22 has a color selection function. That is, the red (R), green (G) and blue (B) beams are focused through the beam-guide aperture 22 to hit the selected phosphors on the phosphor screen 2.

The distance between the centers of the neighboring beam-guide holes is called the "pitch". As shown in FIG. 2, the pitch can be divided into a horizontal pitch P and a vertical pitch V. In the stripe-shaped beam-guide aperture 22, the horizontal pitch P acts as the main pitch.

As described above, the present invention is directed to a multimedia CRT capable of simultaneously satisfying high-brightness and high-resolution requirements.

For high-brightness applications, as previously noted from Eqs. 3 to 6, it is preferable that the beam-guide aperture 22 has a stripe shape capable of giving a relatively high beam-permeability R. In addition, for high-resolution applications, it is preferable that the stripe-shaped beam-guide apertures 22 (collectively referred to hereinafter as "stripes") have a relatively small horizontal pitch P capable of ensuring an under-scanning condition.

The conventional 14 or 15-inch industrial CRT typically has a resolution of 640×480 or 800×600. Among them, the 800×600 resolution CRT is preferably selected because it has the advantages of producing distinct images or large amounts of letters or symbols.

In this respect, the inventive multimedia CRT is preferably a wide 24-inch CRT which has a 800×600 resolution and a 16:9 ratio of the width of the screen to the length of the screen.

A method of establishing the horizontal pitch P of the stripes 22 will be now described in connection with this wide 24-inch CRT.

Figure 3:
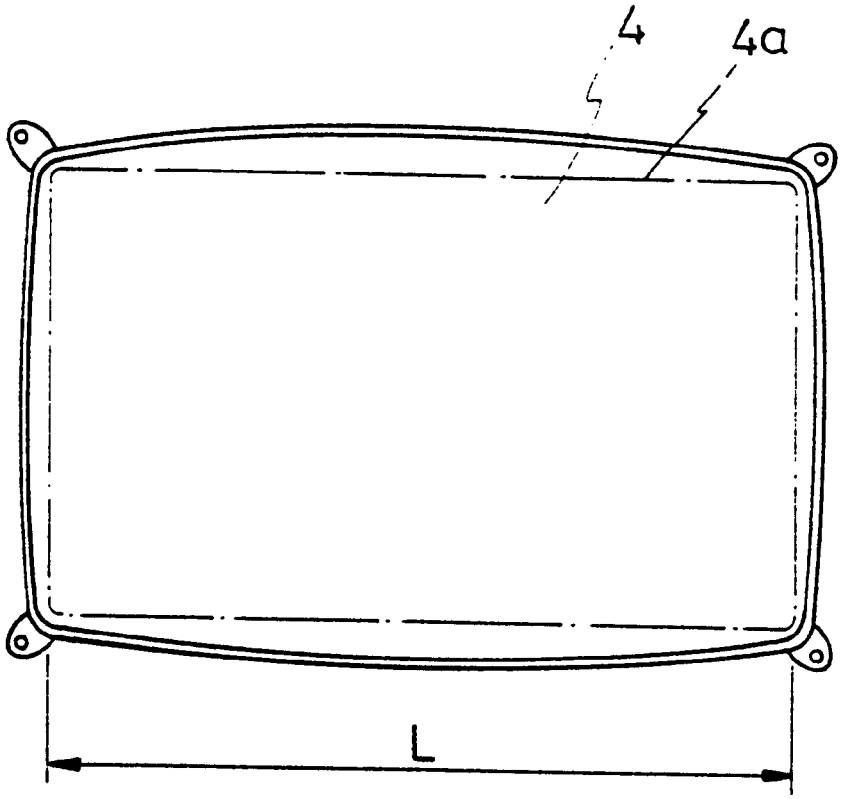
FIG. 3 is a front view of a multimedia CRT showing the effective screen according to a preferred embodiment of the present invention.

FIG. 3 is a front view of a multimedia CRT showing a effective screen 4*a* defined by a dotted line.

The area of the effective screen 4*a* has a fixed value proportional to the CRT size. In industrial CRTs, an under-scanning condition, where the image producing signals are scanned on the screen portion smaller than the effective screen 4*a* by 0~10%, produces high resolution characteristics necessary for correct information display.

In case of the wide 24-inch CRT shown in FIG. 3, the diagonal length of the effective screen 4*a* is 560±5 mm while the longitudinal length is 488 mm.

As shown in FIG. 2, a resolution of 800×600 indicates the total number of stripes 22 formed on the shadow mask 10. Therefore, the masking portion 24 of the shadow mask 10 has stripes 22 with 800 vertical lines and 600 horizontal lines.

Accordingly, assuming that the area of the masking portion 24 is identical with that of the effective screen 4*a*, the horizontal pitch P of the stripes 22 is given by:

$$P=\text{the horizontal length of effective screen/number of vertical lines of stripes}=488/800=0.61\ (\text{mm}) \quad (7)$$

That is, when 800 stripes are longitudinally arranged across the effective screen 4*a*, the horizontal pitch P of the stripes 22 is 0.61 mm. This value practically becomes a maximum value relating to the horizontal pitch P of the stripes 22.

When an additional margin of 20 to 30% is allowed to the maximum value in view of a margin of 5 to 10% for under-scanning and a margin of 15 to 20% for manufacturing error, the horizontal pitch P of the stripes 22 is approximated as follows:

$$P=0.61\times0.8=0.488\approx0.49\ (\text{mm}) \quad (8)$$

$$P=0.61\times0.7=0.427\approx0.43\ (\text{mm}). \quad (9)$$

Eq. 8 is applicable when a margin of 20% is allowed to the horizontal pitch P of the stripes while Eq. 9 is applicable when a margin of 30% is allowed.

As noted from Eqs. 8 and 9, the minimum value is 0.43 to 0.49 mm when computed in view of the maximum margin. Therefore, it is preferable that the horizontal pitch P of the stripes 22 is established at 0.43 mm or more.

Table 1 shows the results of calculating the resolution and brightness of the wide 24-inch CRT while varying the horizontal pitch P of the stripes 22.

TABLE 1

| Pitch (P) (mm) | Resolution | Brightness |
|---|---|---|
| 0.40 | ◎ | x |
| 0.43 | ◎ | Δ |
| 0.49 | ◎ | Δ |
| 0.55 | ○ | ○ |
| 0.60 | Δ | ○ |

The resolution is determined by the focusing characteristic. That is, when the letters displayed on the periphery of the screen are unfocused, the resolution is bad.

As noted from Table 1, when the horizontal pitch of the stripes is over 0.60 mm, the letters at the periphery of the screen are gradually unfocused resulting in bad resolution.

In industrial CRTs, the brightness is good when the brightness ratio of the periphery of the screen to the center of the screen is above 90% because the pitch ratio of the beam-guide holes in the center of the shadow mask to the beam-guide holes at the periphery of the shadow mask is the same.

On the contrary, in public CRTs, the pitch ratio (110 to 140%) of the beam-guide holes at the center of the shadow mask to the beam-guide holes in the periphery of the shadow mask is different. Thus, the brightness is good when the brightness ratio in the center of the screen to the periphery of the screen is above 50%.

Therefore, in the multimedia CRT according to an embodiment of the present invention, the stripe pitch in the center of the shadow mask and the stripe pitch at periphery of the shadow mask differs with a medium range between the industrial CRT and the public CRT. Therefore, the brightness is good when the brightness ratio in the center of the screen to the periphery of the screen is above 75%.

Table 2 shows data measuring the brightness at the periphery of the screen when the brightness in the center of the screen is fixed with 35.5 ft-L.

TABLE 2

| Pitch (P) (mm) | Brightness at periphery of screen | Brightness ratio of center to periphery screen (%) |
|---|---|---|
| 0.40 | 25.9 | 73 |
| 0.43 | 27.7 | 78 |
| 0.49 | 31.6 | 89 |
| 0.55 | 35.5 | 100 |
| 0.60 | 38.7 | 118 |

It can be shown from Tables 1 and 2 that the pitch P of the stripes is in the range of 0.43 to 0.60 mm when the brightness ratio in the center of the screen to the periphery of the screen is above 75% and, hence, is good.

Accordingly, in the wide 24-inch multimedia CRT, the horizontal pitch P of the stripes, where the resolution and brightness are both good, is in the range of 0.43 to 0.60 mm and the optimum value of the horizontal pitch P is 0.55 mm.

When the horizontal pitch P is compared to the horizontal length L of the effective screen 4*a*, their ratio H is given by the following Eqs. 10 and 11:

$$H=0.43/488=8.81\times10^{-4} \quad (10)$$

$$H=0.60/488=1.23\times10^{-3} \quad (11)$$

Therefore, in a multimedia CRT according to a preferred embodiment of the present invention, the ratio H of the longitudinal length L of the effective screen 4*a* to the horizontal pitch P of the stripes 22 in the center of the shadow mask 10 is established with $1:8.81\times10^{-4}$ to $1:1.23\times10^{-3}$.

Accordingly, the multimedia CRT can have good brightness by making the beam-guide hole of the shadow mask into a stripe shape as well as high resolution by reducing the horizontal pitch of the stripe.

The relation of the horizontal pitch to the thickness of the shadow mask will be now described.

Figure 4:
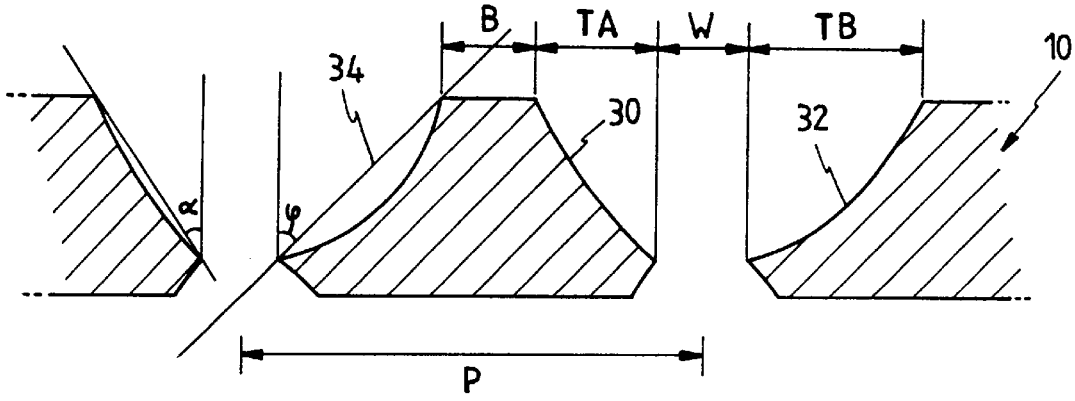
FIG. 4 is a sectional view taken along line A—A of FIG. 2.

FIG. 4 is a cross sectional view taken along A—A line of FIG. 2. One-side or both-side etching is performed to the shadow mask 10 to thereby form a plurality of stripes 22. The shape of the stripe 22 is usually largely depressed in a one-sided direction.

In the figure, W indicates the hole size of the stripe 22 passing the electron beam 34, TA indicates the horizontal length with respect to the left inclined side 30 of the stripe 22, TB indicates the horizontal length with respect to the right inclined side 32 of the stripe, and B (called a "bar") indicates the distance between the neighboring stripes 22.

When the horizontal pitch P of the stripes 22 is reduced to enhance the resolution, an accompanying decrease in the size of the bar B occurs, resulting in a shadow mask 10 that becomes structurally unstable.

Therefore, in order to ensure structural stability, optimum size of the bar B should be considered when reducing the horizontal pitch P of the stripe 22.

The size of the bar B is given by:

$$B=P-W-TA-TB. \quad (12)$$

At first, referring to the horizontal lengths TA and TB with respect to the inclined sides of the stripe 22, the inclined sides of the stripe 22 forms an inclination of 15 to 60° in accordance with the incidence angle of the electron beam 34. The stripes in the center of the shadow mask 10 may be vertically formed because the electron beam 34 is vertically incident upon the shadow mask 10. Nevertheless, the inclined side of the stripe facing the center of the shadow mask 10 and having the horizontal length TA is formed with an inclination of 15° for easy processing. In contrast, the inclined side of the stripe facing the periphery of the shadow mask and having the horizontal length TB is formed with an inclination more than 15° in view of the deflection angle of the electron beam by a deflection yoke.

Figure 5:
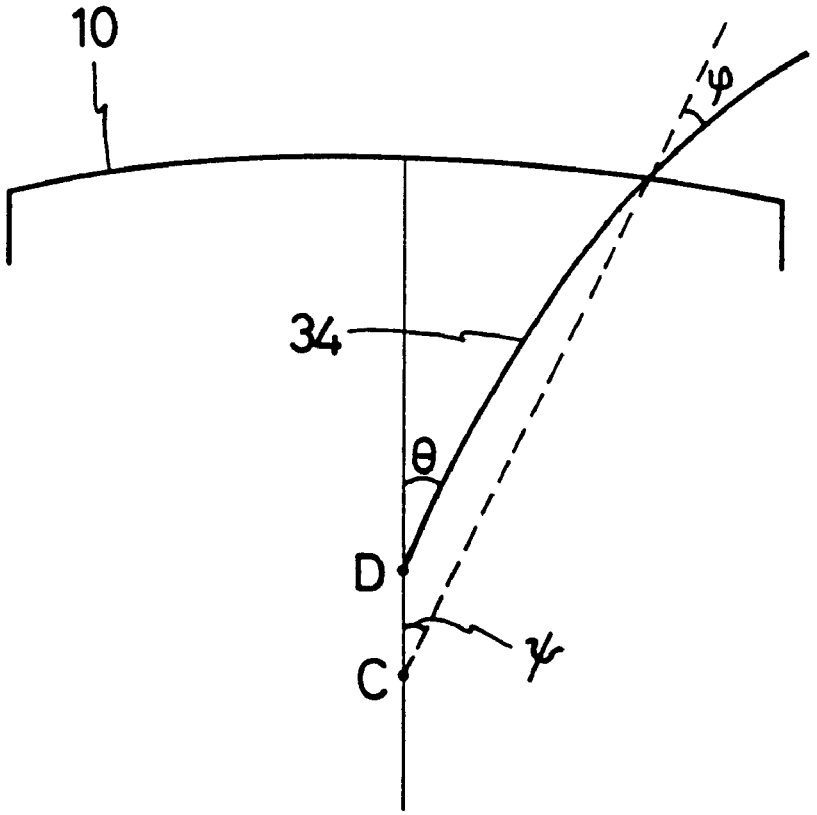
FIG. 5 is a schematic diagram illustrating the relation of the shadow mask to the electron beam according to an embodiment of the present invention.

In order to determine the horizontal lengths TA and TB with respect to the inclined sides of the stripe, an imagined line is vertically drawn from the center of the shadow mask 10 as shown in FIG. 5. Then, a curvature center C and a point of deflection of the electron beams D are established on the line, and an electron beam 34 is assumed to be scanned on an optional point on the shadow mask 10. At this time, assuming that the deflection angle of the electron beam 34 is θ and the angle formed by the curvature center C and the optional point is ψ, the incidence angle φ of the electron beam 34 passing the stripe of the shadow mask 10 is represented by:

$$\phi=\theta-\psi. \quad (13)$$

Therefore, referring to FIG. 4, the horizontal lengths TA and TB (collectively indicated by "T") with respect to the inclined sides 30 and 32 of the stripe 22 can be given by:

$$\tan \psi = T/t \quad (14)$$

$$T = t \times \tan \phi, \quad (15)$$

where t is the thickness of the shadow mask 10.

Strictly speaking with reference to the figure, t is the thickness of the upper etching side. However, since the thickness of the lower etching side is extremely small compared to the total thickness of the shadow mask 10, t can be assumed to be the total thickness of the shadow mask 10 in view of the small error.

Accordingly, the horizontal lengths TA and TB with respect to the inclined sides 30 and 32 can be measured with the thickness of the shadow mask 10 and the incidence angle $\phi$ of the electron beam 34.

When the thickness t of the shadow mask 10 is 0.22 mm, the maximum deflection angle $\theta$ of the electron beam 34 is 46°, and the angle $\psi$ is 11°, the incidence angle $\phi$ of the electron beam 34 obtained from Eq. 13 is 35°.

Therefore, the horizontal length TB with respect to the right inclined side 32 positioned toward the periphery of the shadow mask 10 is approximated by $$TB = 0.22 \times \tan 35° \approx 0.154 \text{ (mm)} \quad (16)$$

However, the left inclined side 30 positioned toward the center of the shadow mask 10 is not particularly affected by the incidence angle $\phi$ of the electron beam 34. Thus, it is formed with the conventional inclination of 15° enabling easy processing of the stripe 22. At this time, the horizontal length TA with respect to the left inclined side 30 is approximated by:

$$TA = t \times \tan \alpha = 0.22 \times \tan 15° \approx 0.06 \text{ (mm)}. \quad (17)$$

In this way, the respective horizontal lengths TA and TB with respect to the inclined sides 30 and 32 of the stripe 22 can be measured.

As noted from Table 1, when the horizontal pitch P of the stripes 22 is established at an optimum value of 0.55 mm satisfying both the resolution and brightness requirements, the width W of the stripes 22 is established with 0.160 mm. When the established values are applied to Eq. 12, the bar B of the stripes 22 is given by:

$$B = 0.55 - 0.160 - 0.154 - 0.060 = 0.176 \text{ (mm)}. \quad (18)$$

When the bar B of the stripes of the conventional 24-inch public CRT is measured for comparison purposes, it is given by:

$$B = 0.76 - 0.160 - 0.154 - 0.060 = 0.386 \text{ (mm)}. \quad (19)$$

This value is obtained by applying the stripe pitch 0.76 mm of the shadow mask used in the conventional 24-inch public CRT to Eq. 12. As noted from Eqs. 18 and 19, when the horizontal pitch P of the stripes 22 is reduced to enhance the resolution, the bar B of the stripes 22 decreases, resulting in structural instability.

Therefore, the bar B of the stripes 22 should be large enough to ensure the structural stability while reducing the horizontal pitch P of the stripes 22.

For this purpose, when the thickness t of the shadow mask 10 is reduced from 0.22 mm to 0.20 mm, 0.18 mm or 0.15 mm, the bar B of the stripes 22 can be computed by using Eqs. 12 and 15 as follows:

$$B = 0.55 - 0.160 - (0.20 \times \tan 15°) - (0.20 \times \tan 35°) = 0.196 \text{ (mm)}, \quad (20)$$

$$B = 0.55 - 0.160 - (0.18 \times \tan 15°) - (0.18 \times \tan 35°) = 0.216 \text{ (mm)}, \quad (21)$$

$$B = 0.55 - 0.160 - (0.15 \times \tan 15°) - (0.15 \times \tan 35°) = 0.245 \text{ (mm)}, \quad (22)$$

As shown from the above equations, when the thickness t of the shadow mask 10 is reduced, the bar B of the stripes 22 becomes larger, enabling micro-processing with respect to the stripes 22.

However, when the thickness t of the shadow mask 10 becomes thinner, the resulting structural weakness makes it difficult to form an appropriate curvature and may produce a doming phenomenon due to thermal expansion and a vibrating phenomenon due to the sonic pressure of the speaker. Thus, it is important that the thickness t of the shadow mask 10 should be kept within the range capable of maintaining the structural stability and mechanical strength of the shadow mask 10.

In this case, it is preferable that the thickness t of the shadow mask 10 be more than 0.15 mm. When the thickness t of the shadow mask 10 is less than 0.15 mm, the stability and strength of the shadow mask 10 cannot be practically maintained.

Furthermore, the thickness t of the shadow mask 10 should be less than 0.24 mm. When the thickness t of the shadow mask 10 is more than 0.24 mm, the time required for the etching process increases and the smooth stripe formation suffers.

Accordingly, as noted from Eqs. 20 to 22, the thickness t of the shadow mask 10 is established between 0.15 and 0.24 mm, the range capable of keeping the appropriate bar B of the stripes 22.

Therefore, when the thickness t of the shadow mask 10 is 0.15 mm and the horizontal pitch P of the stripes 22 is 0.60 mm, the maximum value capable of giving good brightness, the ratio S of thickness t of the shadow mask 10 to the horizontal pitch P of the stripes 22 in the center of the shadow mask 10 is given by:

$$S = 0.15/0.60 = 0.25. \quad (23)$$

Furthermore, when the thickness t of the shadow mask 10 is 0.24 mm and the horizontal pitch P of the stripes 22 is 0.43 mm, the ratio S of the horizontal pitch P of the stripes 22 in the center of the shadow mask 10 to the thickness t of the shadow mask 10 is approximated as:

$$S = 0.24/0.43 \approx 0.56. \quad (24)$$

Accordingly, in a multimedia CRT according to another preferred embodiment of the present invention, the ratio S of the horizontal pitch P of the stripes 22 in the center of the shadow mask 10 to the thickness t of the shadow mask 10 is in the range of 1:0.25 to 1:0.56.

As described above, in the inventive multimedia CRT, it is possible to simultaneously realize high-resolution and high-brightness by establishing the thickness of the shadow mask and the horizontal pitch of the stripes with optimum values. Thus, it can be used for public as well as for industrial purposes. Furthermore, it is applicable in multimedia computer systems or televisions having an Internet connecting function to produce letters and pictures by incorporating various media.

It will be apparent to those skilled in the art that various modifications and variations can be made in the multimedia CRT and the method of making the same of the present invention without departing from the spirit or scope of the invention. Thus, it is intended that the present invention cover modifications and variations of this invention provided they come within the scope of the appended claims and their equivalents.

What is claimed is:

1. A cathode ray tube for multimedia, comprising a shadow mask having a plurality of beam-guide apertures, wherein each of the apertures has a stripe shape, and the ratio of a horizontal length of an effective screen to a horizontal pitch of the beam-guide apertures in the center of the shadow mask is in the range of $1:8.81\times10^{-4}$ to $1:1.23\times10^{-3}$.

2. A cathode ray tube comprising an effective screen area, and a shadow mask having a plurality of stripe shaped beam-guide apertures with a horizontal pitch, said cathode ray tube having a ratio of a horizontal length of the effective screen area to the horizontal pitch at a center of the shadow mask being in the range of $1:8.81\times10^{-4}$ to $1:1.23\times10^{-3}$.

* * * * *